United States Patent [19]

Gallerneault et al.

[11] Patent Number: 4,899,800

[45] Date of Patent: Feb. 13, 1990

[54] METAL MATRIX COMPOSITE WITH COATED REINFORCING PREFORM

[75] Inventors: Willard M. T. Gallerneault; Christopher M. Gabryel, both of Kingston, Canada

[73] Assignee: Alcan International Limited, Montreal, Canada

[21] Appl. No.: 250,759

[22] Filed: Sep. 28, 1988

[30] Foreign Application Priority Data

Oct. 15, 1987 [CA] Canada ..... 549349

[51] Int. Cl.[4] ..... B22D 27/00; B22D 19/14

[52] U.S. Cl. ..... 164/58.1; 164/100; 164/97

[58] Field of Search ..... 164/97, 100, 57.1, 58.1, 164/59.1

[56] References Cited

U.S. PATENT DOCUMENTS 3,466,170 9/1969 Dunkel et al. ..... 420/546
3,970,136 7/1976 Cannet et al. ..... 164/108
4,108,646 8/1978 Gennone et al. ..... 75/148

FOREIGN PATENT DOCUMENTS 829816 12/1969 Canada ..... 53/246

*Primary Examiner*—Kuang Y. Lin
*Attorney, Agent, or Firm*—Cooper & Dunham

[57] ABSTRACT

A process is described for forming a composite cast article comprising an aluminum-silicon alloy matrix containing a modifying amount of strontium and a preform of bonded-together reinforcing fibres incorporated in the matrix, in which the preform of reinforcing fibres is infiltrated under pressure by a melt of the alloy and the composite article thus formed is allowed to solidify by cooling. According to the novel feature, the fibres of the preform are coated with strontium, preferably in the form of SrO, before being infiltrated by the alloy melt. The strontium on the fibres is free to react with the Al-Si melt and thus modify the structure in the region of the preform such that an excess of silicon particles adjacent the fibres is avoided.

8 Claims, No Drawings

METAL MATRIX COMPOSITE WITH COATED REINFORCING PREFORM

BACKGROUND OF THE INVENTION

This invention relates to the production of metal matrix composites, and more particularly to methods of producing cast aluminum alloy composite articles.

Among metal matrix composites (MMC) having important commercial utility are fibre-reinforced articles of aluminum and its alloys, particularly aluminum-silicon alloys. One of the most popular techniques used to manufacture metal matrix composites is melt infiltration. In this procedure a preform of preferably fibrous alumina reinforcing material is infiltrated under pressure by liquid metal. The composite is then allowed to solidify by cooling. The resulting microstructure of the metal matrix is generally not the same as that found in non-reinforced castings.

If the cooling rate of an A1-Si casting is such that the free growth dendrite arm spacing is greater than the average fibre spacing, the metal matrix dendrites will be in the order of this size as they grow avoiding the alumina fibres. This leads to the rejected solute accumulating at the fibres. For A1-Si alloys the solute build-up is comprised of large silicon particles. These large silicon particles have poor physical properties (brittle, different coefficient of thermal expansion) and degrade the ultimate performance of the composite.

In the case where the cooling rate is high enough to ensure the average dendrite size is less than the average fibre spacing, the metal matrix microstructure appears identical to that in the non-reinforced region. However, large casting cross sections of greater than about 20 mm make it impossible to ensure a high enough cooling rate to keep the dendrite size less than the fibre spacing.

It has been known for many years to obtain a fine eutectic structure in A1-Si alloys containing about 5 to 15% silicon, by the use of additives and, thus, to improve the mechanical properties of these alloys. For instance, it is well known to use alkali metals and alkaline-earth metals, e.g. sodium or strontium, as additives in A1-Si alloys. These chemical additions to a melt reduce the silicon size by affecting the normal growth kinetics of the solidification process. It would, therefore, be expected that in a similar manner additives such as sodium or strontium would suitably modify the metal matrix microstructure of a metal matrix composite. However, when the melt contains a fibrous preform reinforcement, sodium and strontium are remarkably ineffective in modifying the metal matrix microstructure of the metal matrix composite. The sodium appears to be totally ineffective, while strontium can be used only with difficulty.

As a consequence, metal matrix composites typically contain large silicon particles and/or large intermetallics which tend to filter out and thereby accumulate at the preform/alloy melt interface during infiltration. These large silicon particles and intermetallics degrade the properties significantly at the composite/alloy interface and to a lesser extent, in the entire composite. For many uses of the metal matrix composites, this loss of properties can be tolerated. However, if the metal matrix composites are to be used in high stress situations where thermal fatigue is a major consideration, the loss of properties cannot be tolerated.

It is the object of the present invention to develop a process for forming a composite cast article in which adequate refining or modification of the eutectic silicon will occur within the preform.

SUMMARY OF THE INVENTION

The present invention relates to a process for forming a composite cast article comprising an aluminum-silicon alloy matrix containing a modifying amount of strontium and a preform of bonded-together reinforcing fibres incorporated in the matrix, wherein the preform of reinforcing fibres is infiltrated under pressure by a melt of the alloy and the composite article thus formed is allowed to solidify by cooling. According to the novel feature, a preform is utilized in which the fibres are coated with strontium before being infiltrated by the alloy melt. It has been found that this precoating with strontium provides improved modification of the cast alloy in the vicinity of the preform.

The technique of the present invention is particularly effective in the situation where the reinforcing fibres of the preform are bonded together by $SiO_2$. Thus, if the $SiO_2$ within the preform is left unprotected, infiltrating liquid aluminum will react with it, reducing it to free silicon and this inevitably leads to excess silicon forming adjacent the fibres. However, when strontium, e.g. in the form of SrO, is deposited on the fibres prior to melt infiltration, then during melt infiltration the aluminum reduces the SrO to Sr leaving it free to react with the A1-Si melt and thus modify the structure. The SrO is preferably deposited on the fibres by dipping the preform into a solution of a precursor for SrO, e.g. $Sr(NO_3)_2$ and $H_2O$. The preform is then dried with heating e.g. in the range of 200° to 800° C. to leave a fine residue of SrO on the alumina fibres. Compounds other than $Sr(No_3)_2$ can be used as precursor for SrO, e.g. strontium acetate or carbonate, and sufficient of the precursor is applied to assure at least a monolayer of elemental strontium on the preform after reduction by the molten aluminum. If desired, the precursor solution may be saturated or super-saturated. The reinforcing fibres themselves may be made of a variety of different materials such as alumina, alumino-silicates, silicon, glass wools, etc.

The A1-Si alloy typically contains about 5 to 15 percent by weight silicon and the melt is typically modified by addition thereto of between about 0.05 and 0.4 percent by weight of strontium. Optimum results are obtained with about 0.02 to 0.08 percent by weight strontium.

The use of coated preforms according to this invention is particularly effective in the method of producing composite cast articles described in U.S. application Ser. No. 710,844, filed Mar. 12, 1985.

Theinvention will now be explained by the following non-limitative example.

EXAMPLE

A preform of reinforcing material was prepared from 3 μm alumina fibre (Saffil® fibre available from ICI). The chopped fibres were coated with a binder consisting of $SiO_2$ based suspension and the coated fibres were filtered into a cake and then calcined to drive off the moisture and form a rigid 20 volume % preform. Preforms of the above type are commercially available from Millmaster Onyx of Fairfield, N.J.

In order to immobilize the activity of the $SiO_2$, the preform was dipped into a saturated solution of $Sr(NO_3)_2+H_2O$. The preform was then baked at 500°

C. for 4 hours to leave a fine residue of SrO on the alumina fibers.

The above preform was heated to 800° C. and placed into a 75 mm diameter die preheated to 500° C. A melt of commercial Al-Si alloy containing nominally 12.35% Si was modified by addition thereto of 0.10 percent by weight strontium. This modified melt was poured on top of the hot preform and a cold ram (25° C.) was used to force the molten alloy into the porous preform. The infiltration pressure was nominally 20 MPa and sufficient of the melt was used to totally infiltrate the preform and result in a composite with free matrix alloy both above and below the preform. The composite thus formed was allowed to solidify by cooling to obtain the desired composite cast article. A cross section of the composite cast article was subjected to metallographic examination by means of optical microscopy and was found to be free of large silicon particles and large intermetallics.

It is to be understood that the invention is not limited to the procedures and embodiments hereinbove specifically set forth, but may be carried out in other ways without departure from its spirit.

We claim:

1. A process for forming a composite cast article which comprises providing a preform of bonded-together reinforcing fibres, coating said reinforcing fibres with strontium, infiltrating the coated preform under pressure by a melt of an aluminum-silicon alloy matrix containing a modifying amount of strontium and allowing the composite article thus formed to solidify by cooling the improvement which comprises utilizing a preform in which the fibers are coated with strontium before being infiltrated by the alloy metal.

2. A process according to claim 1 wherein the reinforcing fibres of the preform are bonded together by $SiO_2$.

3. A process according to claim 2 wherein the fibers are formed of alumina.

4. A process according to claim 2 wherein the coating of strontium on the preform comprises SrO.

5. A process according to claim 2 wherein aluminum-silicon alloy contains about 5 to 15 percent by weight of silicon.

6. A process according to claim 4 wherein the preform is coated with a precursor for SrO which forms SrO under heating.

7. A process according to claim 6 wherein the precursor for SrO is selected from the class consisting of strontium nitrate, acetate and carbonate.

8. A process according to claim 6 wherein sufficient of the SrO precursor is applied to result in at least a monolayer of elemental strontium on the preform after reduction of the SrO by the alloy melt.

* * * * *